US007576488B2

(12) United States Patent
Moon et al.

(10) Patent No.: US 7,576,488 B2
(45) Date of Patent: Aug. 18, 2009

(54) MULTI-TYPED PLASMA DISPLAY PANEL

(75) Inventors: Gwon Jin Moon, Gyoungsangbuk-do (KR); Gwang Pyo Choi, Gyoungsangbuk-do (KR); Seok Joon Moon, Gyoungsangbuk-do (KR); Hea Sung Jang, Daegu (KR)

(73) Assignee: Orion PDP Co., Ltd., Kyungsangbuk-do (KR)

( * ) Notice: Subject to any disclaimer, the term of this patent is extended or adjusted under 35 U.S.C. 154(b) by 614 days.

(21) Appl. No.: 10/540,719

(22) PCT Filed: Dec. 24, 2003

(86) PCT No.: PCT/KR03/02835

§ 371 (c)(1),
(2), (4) Date: Jun. 24, 2005

(87) PCT Pub. No.: WO2004/059685

PCT Pub. Date: Jul. 15, 2004

(65) Prior Publication Data

US 2006/0071594 A1 Apr. 6, 2006

(30) Foreign Application Priority Data

Dec. 27, 2002 (KR) ..... 10-2002-0085171

(51) Int. Cl.
*H01J 17/49* (2006.01)

(52) U.S. Cl. ..... 313/582; 313/586; 313/292

(58) Field of Classification Search ..... 313/582–587, 313/292, 609
See application file for complete search history.

(56) References Cited

U.S. PATENT DOCUMENTS 5,428,263 A * 6/1995 Nagano ..... 313/585
5,670,843 A * 9/1997 Matsuura ..... 313/582
5,886,467 A * 3/1999 Kimura ..... 313/582
6,400,080 B1 * 6/2002 Tanaka ..... 313/582

(Continued)

FOREIGN PATENT DOCUMENTS

JP 9-223276 8/1997

(Continued)

OTHER PUBLICATIONS

Notice of Allowance for corresponding Korean patent application 10-2002-0085171.

*Primary Examiner*—Joseph L Williams
*Assistant Examiner*—Kevin Quarterman
(74) *Attorney, Agent, or Firm*—Merchant & Gould P.C.

(57) ABSTRACT

Disclosed is a multi-typed plasma display panel for preventing internal penetration of a seal line by forming a barrier rib in a vertical direction, in a horizontal direction or in both directions. In the multi-typed plasma display panel, a barrier rib is formed according to a cross-section in a vertical direction, in a horizontal direction or in both directions so that a seal line of the cross-section is prevented from being penetrated internally. In the horizontal direction, an auxiliary barrier rib may be further formed outside the barrier rib. Additionally, a dielectric of the rear panel is removed as large as an area separated from the cross-section in a predetermined distance so that the seal line may be formed in a condition where a glass is exposed.

5 Claims, 6 Drawing Sheets

U.S. PATENT DOCUMENTS

| | | | | |
|---|---|---|---|---|
| 6,414,434 | B1 * | 7/2002 | Nakano et al. | 313/582 |
| 6,646,376 | B2 * | 11/2003 | Yonehara et al. | 445/24 |
| 6,809,476 | B2 * | 10/2004 | Lee et al. | 313/581 |
| 7,030,560 | B2 * | 4/2006 | Ko et al. | 313/582 |

FOREIGN PATENT DOCUMENTS

| | | | |
|---|---|---|---|
| JP | 10-207402 | | 8/1998 |
| JP | 2000-106093 | | 4/2000 |
| JP | 2000-106093 | | 11/2000 |
| JP | 2001-15026 | | 1/2001 |
| JP | 2003-100213 | | 4/2003 |
| KR | 1995-0024133 | | 8/1995 |
| KR | 10-0143960 | B1 | 4/1998 |
| KR | 100143960 | | 4/1998 |
| KR | 10-20000044624 | A | 7/2000 |
| KR | 2000-0044624 | | 7/2000 |
| KR | 10-20010082878 | A | 8/2001 |
| KR | 2001-0082878 | | 8/2001 |

* cited by examiner

MULTI-TYPED PLASMA DISPLAY PANEL

TECHNICAL FIELD

The present invention relates to a multi-typed plasma display panel, and more particularly, to a multi-typed plasma display panel for preventing internal penetration of a seal line by forming barrier ribs in a horizontal direction, in a vertical direction or in both directions.

BACKGROUND ART

A large screen display device, as shown in FIG. 1, can be formed by assembling unit plasma display panels A, B, C and D. The unit plasma panel used in manufacturing a large screen is called a multi-typed plasma display panel.

When a multi-typed plasma display panel is assembled as described above, a seam area is formed on adjacent sides 5 of each panel. The seam area includes a seal line for sealing sides of the multi-typed plasma display panel.

The multi-typed plasma display panel is manufactured by cutting a rear substrate 10 of FIG. 2 and a front substrate 20 of FIG. 3 in a predetermined size, arranging the rear substrate 10 and the front substrate 20 and coating a seal line 26 and then combining the rear substrate 10 and the front substrate 20.

In particular, a plurality of barrier ribs 12 and a plurality of address electrodes 14 are formed alternately in the rear substrate 10 in a vertical direction, and a plurality of electrodes 22 (electrodes X and Y) are formed horizontally in the front substrate 20.

In order to combine the rear substrate 10 and the front substrate 20, each substrate is cut according to a predetermined vertical cut line H and a horizontal cut line I. The vertical cut line H and the horizontal cut line I are defined in a certain area at the side of a display area.

After the rear substrate 10 and the front substrate 20 are cut, they are arranged up and down as shown in FIG. 4, where the seal line is coated, and the rear substrate 10 and the front substrate 20 are sealed and exhausted.

In a conventional multi-typed plasma display panel of FIG. 4, the penetration of the seal line 26 is generated in a portion cut by the horizontal cut line I like the area E1, as shown in FIG. 5, due to a gap formed by the barrier rib 12.

As shown in said FIG. 5, if the seal line penetrates into the vertical cross-section, the penetration not only causes contamination of the side light emitting area of the multi-typed plasma display panel but also enlarges the seam area.

Moreover, in the cross-section cut by the horizontal cut line H as the E2 area of FIG. 4, the seal line 26 is coated on the top of the barrier rib 12 located in the most outside barrier rib, as shown in FIG. 6, which results in enlargement of a vertical gap of the panel, thereby generating mis-discharge at operation. Furthermore, in the FIG. 6, the seal line 26 also penetrates into a discharge cell, which causes contamination of the light emitting area and enlarges the seam area.

In addition, in the conventional multi-typed plasma display panel, outgasing is generated by the unstable sealing operation, thereby degrading reliability and durability of the product.

DETAILED DESCRIPTION OF THE INVENTION

Accordingly, it is an object of the present invention to provide a multi-typed plasma display panel for preventing internal penetration of a side seal line by forming barrier rib in a vertical direction, in a horizontal direction or in both directions.

It is another object of the present invention to provide a multi-typed plasma display panel having a reinforced adhesive force of a cross-section, thereby improving reliability and durability of the product.

In the multi-typed plasma display panel according to an embodiment of the present invention, barrier ribs are formed along the cross section in a horizontal direction, in a vertical direction or in both directions in order to prevent internal penetration of a seal line.

Moreover, in accordance with an embodiment of the present invention, an auxiliary barrier rib may be further formed in the outside of the barrier in a vertical direction.

Furthermore, a dielectric surface of the rear substrate is removed as much as an area separated at a certain distance from the cross-section, where a seal line is formed in a glass exposure condition.

PREFERRED EMBODIMENTS OF THE INVENTION

The present invention discloses embodiments of a multi-typed plasma display panel wherein a barrier rib is applied to a vertical cross-section, a horizontal cross-section or both. The illustration of electrodes (an electrode X, an electrode Y, and an address electrode) in the embodiments is omitted to simplify the explanation.

First, embodiments wherein a horizontal barrier rib is formed are described.

Figure 1:
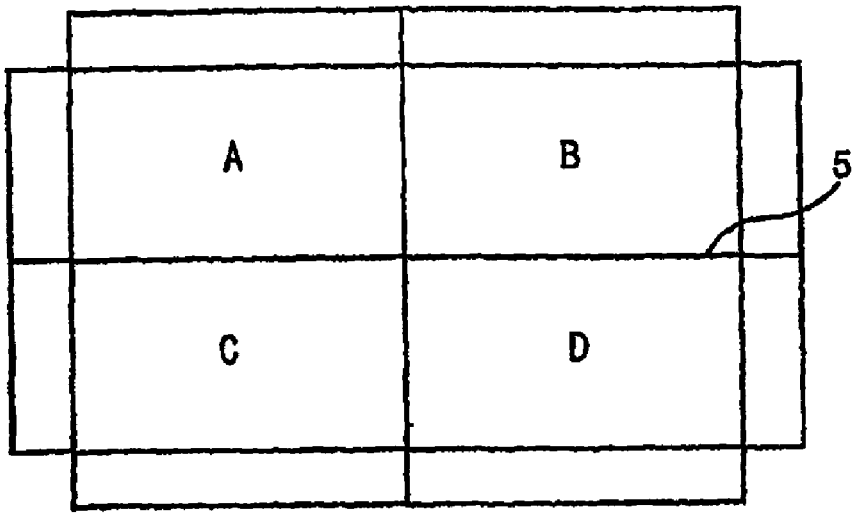
Fig.1 (PRIOR ART)
FIG. 1 is a diagram of a large screen display device formed by assembling conventional multi-typed plasma display panels.
Figure 2:
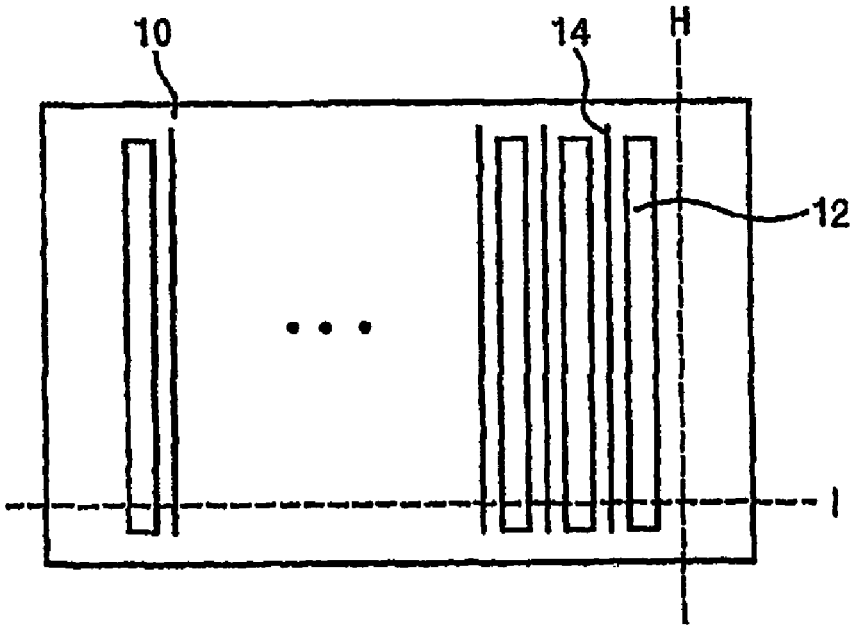
Fig.2 (PRIOR ART)
FIG. 2 is a plane diagram of a rear substrate for manufacturing a multi-typed plasma display panel.
Figure 3:
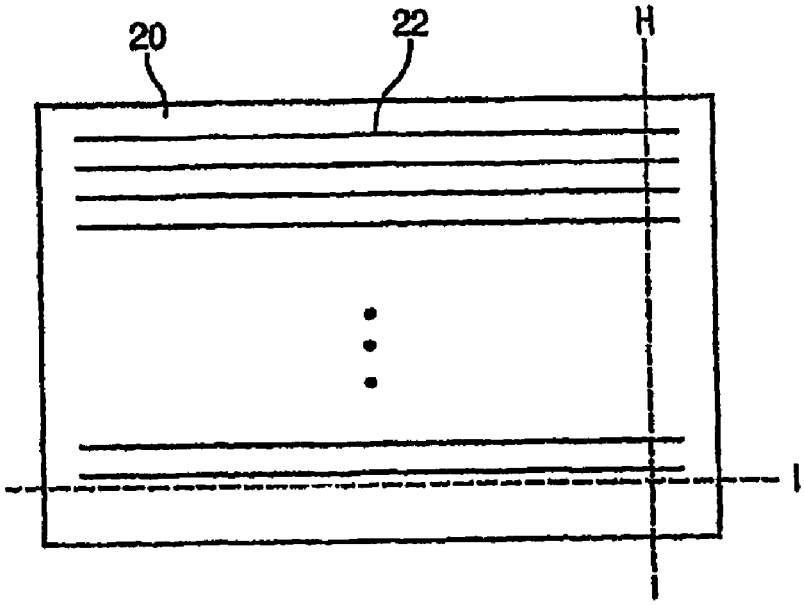
Fig.3 (PRIOR ART)
FIG. 3 is a plane diagram of a front substrate for manufacturing a multi-typed plasma display panel.
Figure 4:
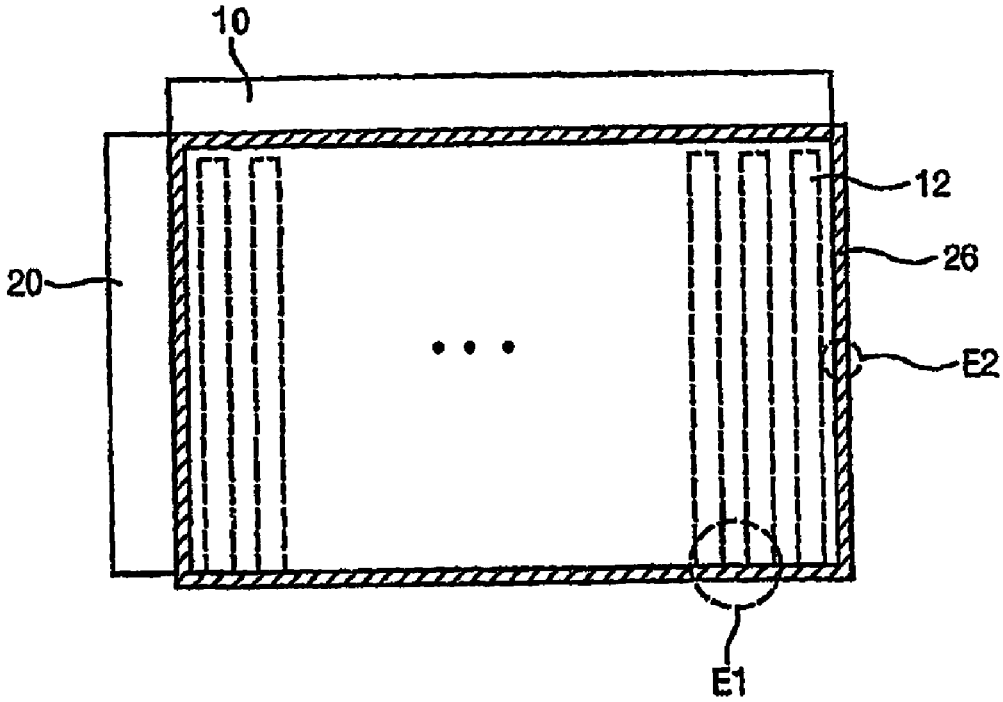
Fig.4 (PRIOR ART)
FIG. 4 is a plane diagram of a conventional multi-typed plasma display panel.
Figure 5:
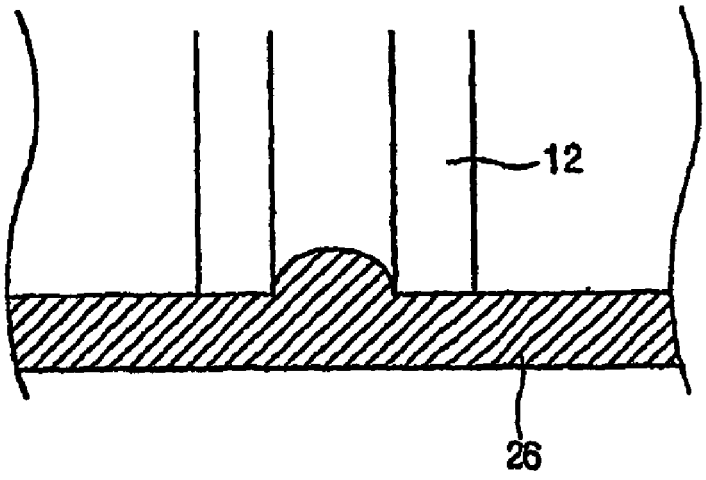
Fig.5 (PRIOR ART)
FIG. 5 is a diagram illustrating sealant penetration in an E1 area of FIG. 4.
Figure 6:
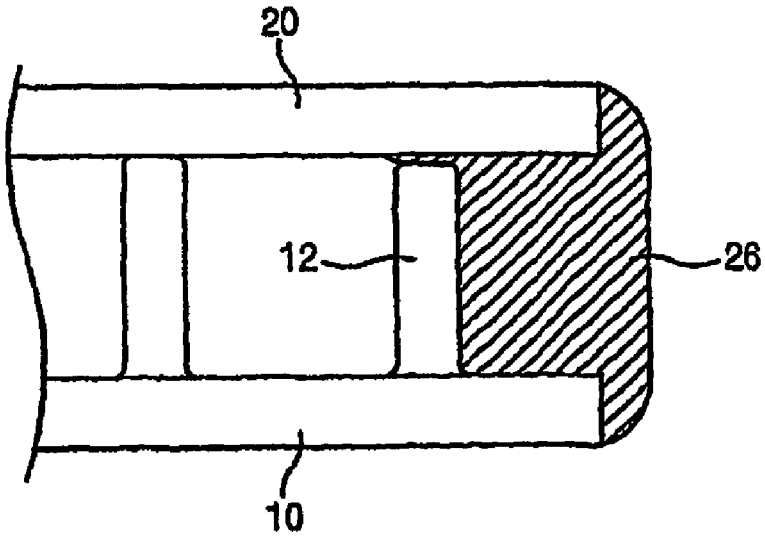
Fig.6 (PRIOR ART)
FIG. 6 is a diagram illustrating sealant penetration in an E2 area of FIG. 4.
Figure 7:
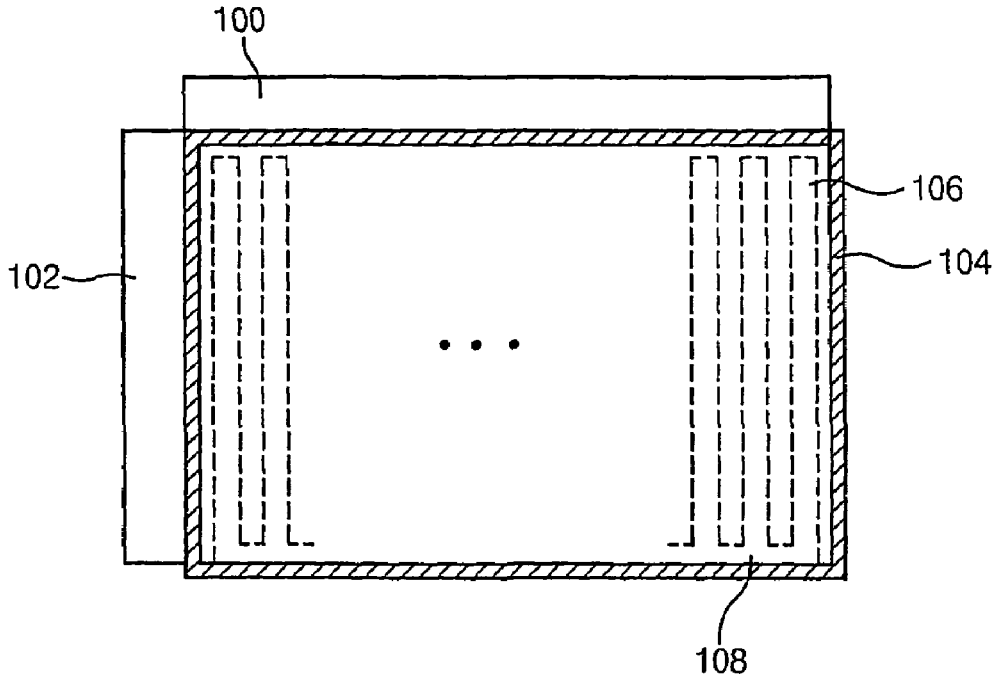
FIG. 7 is a plane diagram of the first embodiment of a multi-typed plasma display panel according to the present invention.

Referring to FIG. 7, in the first embodiment, a rear substrate 100 and a front substrate 102 are adhered by a seal line 104, and a vertical barrier rib 106 and a horizontal barrier rib 108 are formed on the rear substrate 100.

In a horizontal direction a plurality of barrier ribs 106 are formed on the whole surface of the rear substrate 100, and each barrier rib 106 is lined alternately in parallel with an address electrode (not shown). Furthermore, the horizontal barrier rib 108 which us extended to the edge of the barrier rib 106 is located at a side contacting the vertical cross-section.

In this regard, the barrier rib 108 and the barrier rib 106 are formed in lines perpendicular to each other.

As described in the above, in the first embodiment, the barrier rib 108 in the horizontal direction intercepts penetration of the seal line into the horizontal cross-section of the multi-typed plasma display panel, thereby preventing the seal line from contaminating a light emitting area and a seam area from being enlarged.

Figure 8:
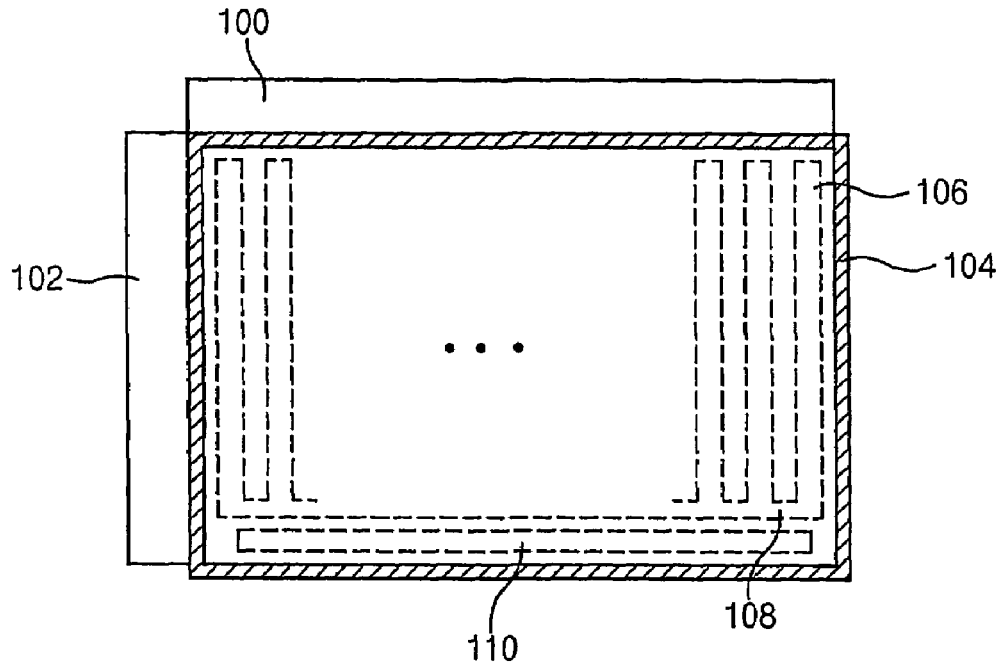
FIG. 8 is a plane diagram illustrating a second embodiment of a multi-typed plasma display panel according to the present invention.

Moreover, as shown in FIG. 8, in the second embodiment, a multi-typed plasma display panel may further comprise an auxiliary barrier rib 110 formed in parallel with the barrier rib 108.

The barrier rib 108 and the auxiliary barrier rib 110 may be separated at the same distance with the separation width of the barrier ribs 106 of the display area or differently designed. The width of the barrier rib 108 and the auxiliary barrier rib 110 may also be configured to have the same or different width with that of the barrier ribs 106 in the display area.

Therefore, in the second embodiment of FIG. 8 the, auxiliary barrier rib 110 may tightly block penetration of seal line 104 into the light emitting area.

Hereinafter, embodiments wherein a vertical barrier rib is formed are described.

Figure 9:
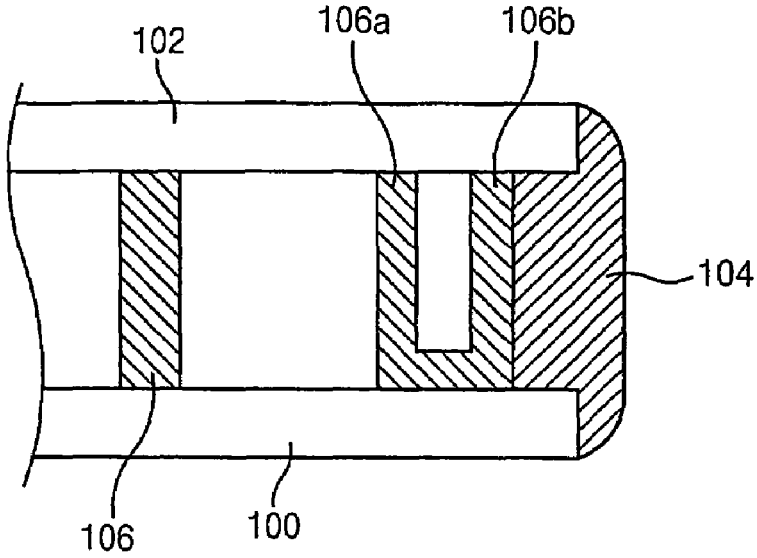
FIG. 9 is a plane diagram illustrating a third embodiment of a multi-typed plasma display panel according to the present invention.
Figure 10:
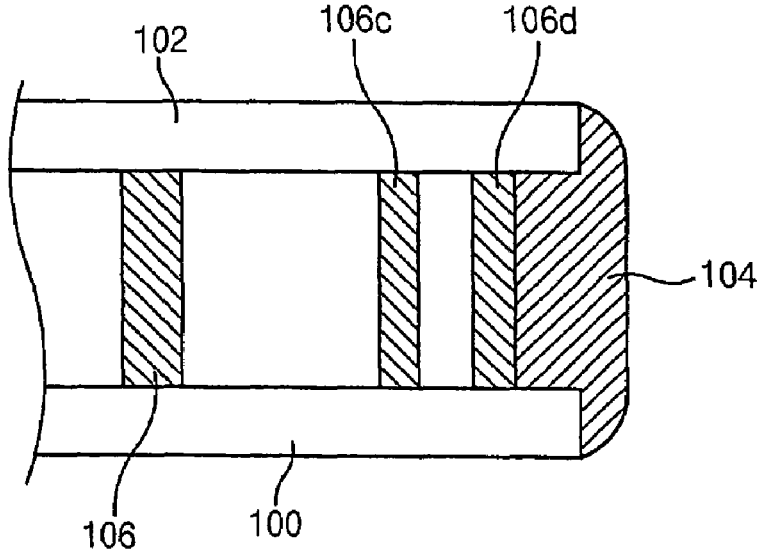
FIG. 10 is a plane diagram illustrating a fourth embodiment of a multi-typed plasma display panel according to the present invention.

As shown in FIGS. 9 and 10, barrier ribs 106*b* and 106*d* may be formed outside the most outside of barrier ribs 106*a* and 106*c* that are adjacent to the vertical cross-section of the multi-typed plasma display panel. The third embodiment shown in FIG. 9 illustrates a narrow space between the most outside barrier ribs 106*a* and 106*b* where the bottom is not fully opened. The fourth embodiment of FIG. 10 illustrates where the bottom between the most outside barrier ribs 106*c* and 106*d* is fully opened.

In the third and fourth embodiment, the barrier ribs 106*b* and 106*d* intercept internal penetration of the seal line 104 on the side.

Therefore, contamination of the light emitting area in the horizontal cross-section of the multi-typed plasma display panel and enlargement of the seam area are prevented.

Figure 11:
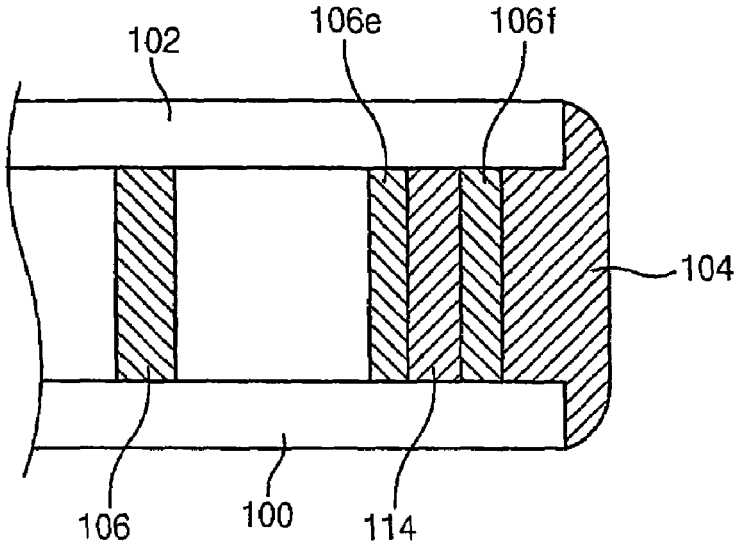
FIG. 11 is a plane diagram illustrating a fifth embodiment of a multi-typed plasma display panel according to the present invention.
Figure 12:
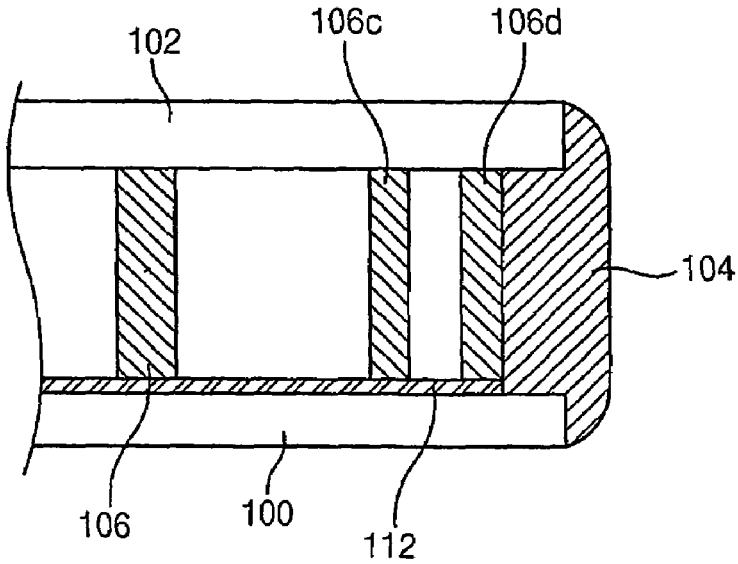
FIG. 12 is a plane diagram illustrating a sixth embodiment of a multi-typed plasma display panel according to the present invention.

Meanwhile, the fifth and the sixth embodiment shown in FIGS. 11 and 12 may be provided in order to strengthen an adhesive force of the rear substrate 100 and the front substrate 102.

In the fifth embodiment, a space 114 between most outside barrier ribs 106*e* and 106*f* formed in the third and fourth embodiments is filled with sealant. In this case, the rear substrate 100 and the front substrate 102 may be solidly combined by the adhesive force of the sealant filled in the space 114.

Moreover, in the sixth embodiment of FIG. 12, a dielectric surface 112 formed on top of the rear substrate 100 is formed to the area separated in a predetermined distance from the cross-section. Here, the detailed illustration of the dielectric 112 is omitted for simplicity of description in the first to the fifth embodiments.

In the above-described sixth embodiment, the seal line 104 contacts the rear substrate 100 as much as the dielectric surface 112 is removed. That is, the dielectric surface 112 is removed, and when a glass surface of the rear substrate 100 is exposed, the seal line 104 is formed.

The sealant composing the seal line 104 is more cohesive to the glass composing the rear substrate 100 than the dielectric surface 112. In this regard, the adhesive force between the rear substrate 100 and the front substrate 102 is strengthened as much as the dielectric surface 112 of the rear substrate 100 is removed.

INDUSTRIAL APPLICABILITY

In this regard, according to the embodiments of the present invention, vertical and horizontal cross-sections of the multi-typed plasma display panel may prevent seal line from contaminating a light emitting area and a seam area from being enlarged.

Furthermore, reinforcing the adhesive force between rear and front substrates elevates confidentiality corresponding to outgasing, thereby improving the reliability and durability of the product.

What is claimed is:

1. A multi-typed plasma display panel which is a unit plasma display panel used for forming a large screen, the large screen including at least a first and a second interconnected unit plasma display panel, comprising:

a front substrate;

a rear substrate sealed with the front substrate;

a plurality of first barrier ribs formed on the rear substrate, the plurality of first barrier ribs dividing a display area into display cells;

at least one cross-section in the first unit plasma display panel and which faces the second unit plasma display panel; and at least one second barrier rib formed along the cross-section inside of a seal line in order to prevent the sealant of the seal line from penetrating into the inside of the first unit plasma display panel, wherein the second barrier rib is extended to the edge of the plurality of first barrier ribs and formed perpendicular to the edge, the second barrier rib being connected to the plurality of first barrier ribs.

2. The panel according to claim 1, wherein an auxiliary barrier rib is further formed between the second barrier rib and the cross-section and separated from the second barrier rib in parallel.

3. A multi-typed plasma display panel which is a unit plasma display panel used for forming a large screen, the large screen including at least a first and a second interconnected unit plasma display panel, comprising:

a front substrate;

a rear substrate sealed with the front substrate;

a plurality of first barrier ribs formed on the rear substrate, the plurality of first barrier ribs dividing a display area into display cells;

at least one cross-section in the first unit plasma display panel and which faces the second unit plasma display panel;

at least one second barrier rib formed along the cross-section inside of a seal line in order to prevent the sealant of the seal line from penetrating into the inside of the first unit plasma display panel, wherein the second barrier rib is formed between the outermost barrier rib which is adjacent to the cross-section in plurality of first barrier ribs and the seal line of the cross-section; and a sealant is filled in a space between the second barrier rib and the most outside barrier rib.

4. A multi-typed plasma display panel which is a unit plasma display panel used for forming a large screen, the large screen including at least a first and a second interconnected unit plasma display panel, comprising:

a front substrate;

a rear substrate sealed with the front substrate;

a plurality of first barrier ribs formed on the rear substrate, the plurality of first barrier ribs dividing a display area into display cells;

at least one cross-section in the first unit plasma display panel and which faces the second unit plasma display panel;

at least one second barrier rib formed along the cross-section inside of a seal line in order to prevent the sealant of the seal line from penetrating into the inside of the first unit plasma display panel, wherein the second barrier rib is formed between the outermost barrier rib which is adjacent to the cross-section in plurality of first barrier ribs and the seal line of the cross-section; and a dielectric surface of the rear substrate is removed as much as an area separated at a predetermined distance from the cross-section, where the seal line is formed in a glass exposure condition.

5. The panel according to claim 4, wherein the removal of the dielectric surface of the rear substrate is performed on the area between the second barrier rib and the cross-section.

* * * * *